US009213258B2

(12) United States Patent
Goto et al.

(10) Patent No.: US 9,213,258 B2
(45) Date of Patent: Dec. 15, 2015

(54) DEVELOPING ASSEMBLY, PROCESS CARTRIDGE, AND IMAGE-FORMING APPARATUS

(71) Applicant: CANON KABUSHIKI KAISHA, Tokyo (JP)

(72) Inventors: Gosuke Goto, Kawasaki (JP); Masato Koyanagi, Ibaraki (JP); Kazutoshi Ishida, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/459,630

(22) Filed: Aug. 14, 2014

(65) Prior Publication Data

US 2015/0055988 A1 Feb. 26, 2015

(30) Foreign Application Priority Data

Aug. 23, 2013 (JP) ..... 2013-173703

(51) Int. Cl.
*G03G 15/08* (2006.01)
*G03G 15/095* (2006.01)
*G03G 15/06* (2006.01)

(52) U.S. Cl.
CPC ..... *G03G 15/0812* (2013.01); *G03G 15/065* (2013.01); *G03G 15/0818* (2013.01); *G03G 2215/0653* (2013.01)

(58) Field of Classification Search
CPC ..... G03G 15/0806; G03G 15/0812; G03G 15/0818; G03G 15/0808
See application file for complete search history.

(56) References Cited

U.S. PATENT DOCUMENTS

| | | | | |
|---|---|---|---|---|
| 5,220,383 | A * | 6/1993 | Enoki et al. | 399/285 |
| 5,379,097 | A * | 1/1995 | Aoto et al. | 399/222 |
| 5,879,849 | A * | 3/1999 | Sawada et al. | 430/108.7 |
| 6,952,551 | B2 | 10/2005 | Koyanagi et al. | |
| 7,239,832 | B2 | 7/2007 | Takashima et al. | |
| 7,457,554 | B2 | 11/2008 | Matsuda et al. | |
| 7,711,279 | B2 | 5/2010 | Matsuda et al. | |
| 2002/0022188 | A1* | 2/2002 | Hashimoto et al. | 430/108.1 |
| 2008/0153026 | A1* | 6/2008 | Giannetto et al. | 430/111.32 |
| 2013/0223891 | A1 | 8/2013 | Koyanagi et al. | |

FOREIGN PATENT DOCUMENTS

| | | | |
|---|---|---|---|
| JP | 3162219 | B2 | 4/2001 |
| JP | 3272056 | B2 | 4/2002 |
| WO | 2013/128551 | A1 | 9/2013 |

OTHER PUBLICATIONS

Gosuke Goto et al., U.S. Appl. No. 14/459,639, filed Aug. 14, 2014.

* cited by examiner

*Primary Examiner* — Clayton E Laballe
*Assistant Examiner* — Leon W Rhodes, Jr.
(74) *Attorney, Agent, or Firm* — Fitzpatrick, Cella, Harper & Scinto

(57) ABSTRACT

In a developing assembly, the surface of a developer bearing member on which a developer is borne is provided with a first dielectric portion and a second dielectric portion. A regulating portion that regulates the layer thickness of the developer borne on the developer bearing member, the first dielectric portion, and the second dielectric portion each have a charge polarity opposite to the charge polarity of the developer. In a triboelectric series, one of the first dielectric portion and the second dielectric portion is positioned between the developer and the other dielectric portion, and the other dielectric portion is positioned between the one of the dielectric portions and the regulating portion.

15 Claims, 13 Drawing Sheets

DEVELOPING ASSEMBLY, PROCESS CARTRIDGE, AND IMAGE-FORMING APPARATUS

BACKGROUND OF THE INVENTION

1. Field of the Invention

The present invention relates to a developing assembly that is used for an image-forming apparatus based on an electrophotographic system.

2. Description of the Related Art

A developing assembly, that does not include a developer supply member, has been proposed to downsize and reduce cost of a developing assembly. The developer supply member has a function to supply and scrape off developer (hereafter called "toner") to/from a developing roller (developer bearing member), and is installed mainly for handling a ghost and a solid image follow-up failure. A ghost is a phenomenon that appears when a half tone image is formed after a high density solid image is formed, where the traces of the solid image appear on the half tone image. A solid image follow-up failure is a phenomenon that appears when a 100% solid image is drawn on the entire surface of an image, where the density of the rear end of the image decreases. Therefore in order to omit the developer supply member, these problems must be handled by a different means. In Japanese Patents Nos. 3272056 and 3162219, a developing assembly that does not include a developer supply member is proposed, where dielectric portions and conductor portions are regularly or irregularly mixed and distributed on the surface of a developing roller. In other words, the dielectric portion on the surface of the developing roller is rubbed by a toner layer thickness regulating member (developer regulating member) directly or via toner, whereby the dielectric portion is charged and a minute closed electric field is formed on an adjacent part with the conductor portion. The toner conveyed to the surface of the developing roller is subject to the gradient force generated by the minute closed electric field and is sucked to and borne on the surface of the developing roller.

According to Japanese Patents Nos. 3272056 and 3162219, if the charging polarity of toner is negative, the developing assembly is constructed such that (−) toner<developer regulating member<dielectric portion (+) is established in a triboelectric series. By this configuration, multilayer toner can be borne on the surface of the developer roller, and the generation of a solid image follow-up failure can be suppressed.

However the inventors discovered that if the dielectric portion is positioned to the side closer to the opposite polarity of the charging polarity of the toner than to the developer regulating member on the triboelectric series, as in the case of Japanese Patents Nos. 3272056 and 3162219, a ghost is easily generated. In the configuration of the prior art, toner borne by the dielectric portion strongly adheres to the dielectric portion electrostatically, therefore regulating the toner layer thickness is difficult, and the toner coating amount on the developing roller, when the solid white image is formed, becomes higher compared with the case of forming a solid image. This difference in the toner coating amount may appear in the image as a ghost. Further, the developer regulating member has only the function to adjust the coating amount, and has no scraping off function, hence if a low printing page is continuously outputted, toner may melt and adhere to the developing roller. To avoid these image defects due to the melt adhesion of toner, the life of the developing assembly in some cases may be set to be short. Furthermore, in a high-humidity high-temperature environment, the charge on the toner borne on the conductor portions may flow from the conductor portions to core metal, resulting in reduced triboelectricity and possible fogging.

SUMMARY OF THE INVENTION

It is an object of the present invention to provide a technique that allows better image formation in an image-forming apparatus.

To achieve the above object, the typical configuration disclosed in the present patent application comprising:

DESCRIPTION OF THE EMBODIMENTS

Embodiments of the present invention will be described using examples with reference to the drawings. Dimensions, materials and shapes of the components and relative configurations thereof according to the embodiments should be appropriately changed in accordance with the configuration and various conditions of the apparatus to which the invention is applied. In other words, the following embodiments are not intended to limit the scope of the present invention.

Example 1

<Image-Forming Apparatus>

Figure 4:
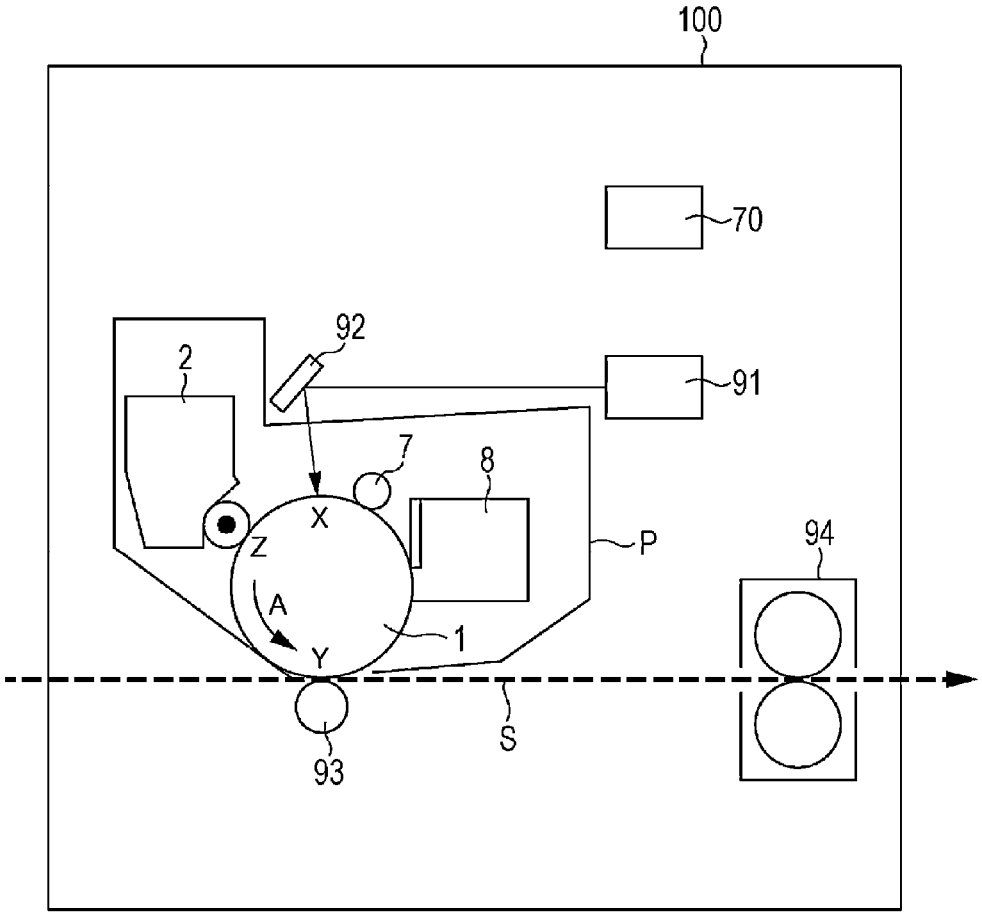
FIG. 4 is a schematic cross-sectional view of an image-forming apparatus according to Example 1.

FIG. 4 shows a general configuration of an image-forming apparatus 100 according to an example of the present invention. Here the image-forming apparatus (electrophotographic image-forming apparatus) is for forming an image on a recording material (recording medium) by developer (toner) using the electrophotographic image forming process. For example, [the image-forming apparatus] includes an electrophotographic copier, an electrophotographic printer (e.g. an LED printer, a laser beam printer), an electrophotographic facsimile device, an electrophotographic word processor, and a composite machine thereof (multifunction printer). The recording material is a recording medium on which an image is formed, such as recording paper, an OHP sheet, a plastic sheet and cloth. As a major configuration, the image-forming apparatus 100 of this example includes a photosensitive drum 1, a developing assembly 2, a cleaning apparatus 8, a charging roller 7, an exposure apparatus 91, a transfer roller 93 and a fixing unit 94. The photosensitive drum 1, the developing assembly 2, the cleaning apparatus 8 and the charging roller 7 are integrated as a process cartridge P, which is detachable from the image-forming apparatus main body (portion of the image-forming apparatus 100 that remains after the process cartridge P is detached). As the process cartridge, another configuration may be used, where the electrophotographic photosensitive drum, and at least one process unit out of a charging apparatuses, a developing unit, and a cleaning unit that works on the electrophotographic photosensitive drum, are integrated into one cartridge. The developing assembly 2 may be a standalone unit that is detachable from the apparatus main body or the process cartridge P. The developing assembly 2 includes toner that has negative normal charging polarity to develop an electrostatic latent image. (The normal charging polarity of the toner is negative in this example, since an electrostatic latent image with negative polarity is reversal-developed.)

The exposure apparatus 91 and a reflective mirror 92 are disposed so that the laser beam emitted from the exposure apparatus 91 reaches an exposure position X on the photosensitive drum 1 via the reflective mirror 92. The transfer roller 93 is disposed in the lower part of the photosensitive drum 1. A transfer material S after transfer is sent to the fixing unit 94. The cleaning apparatus 8 is installed downstream in the moving direction of the photosensitive drum from the transfer position. The attachment blade is disposed such that toner on the photosensitive drum 1 can be scraped off.

An image forming operation of the image-forming apparatus will now be described. A controller unit 70 comprehensively controls the following image forming operation according to a predetermined control program or reference table. First the surface of the photosensitive drum 1, which is rotating in the arrow A direction at 100 mm/sec, is charged to a predetermined potential by the charging roller 7. In the exposure position X, an electrostatic latent image is formed on the photosensitive drum 1 by the laser beam, which is emitted from the exposure apparatus 91 in accordance with an image signal. The formed electrostatic latent image is developed in a developing position Z by the developing assembly 2 so that the toner image is formed. The toner image formed on the photosensitive drum 1 is transferred to a transfer material S at a transfer position Y. The transfer material S, which is a recording medium on which the toner image is transferred, is sent to the fixing unit 94. The fixing unit 94 pressurizes and heats the toner image on the transfer material S so that the toner image is fixed on the transfer material S, and the final image is formed.

Figure 1:
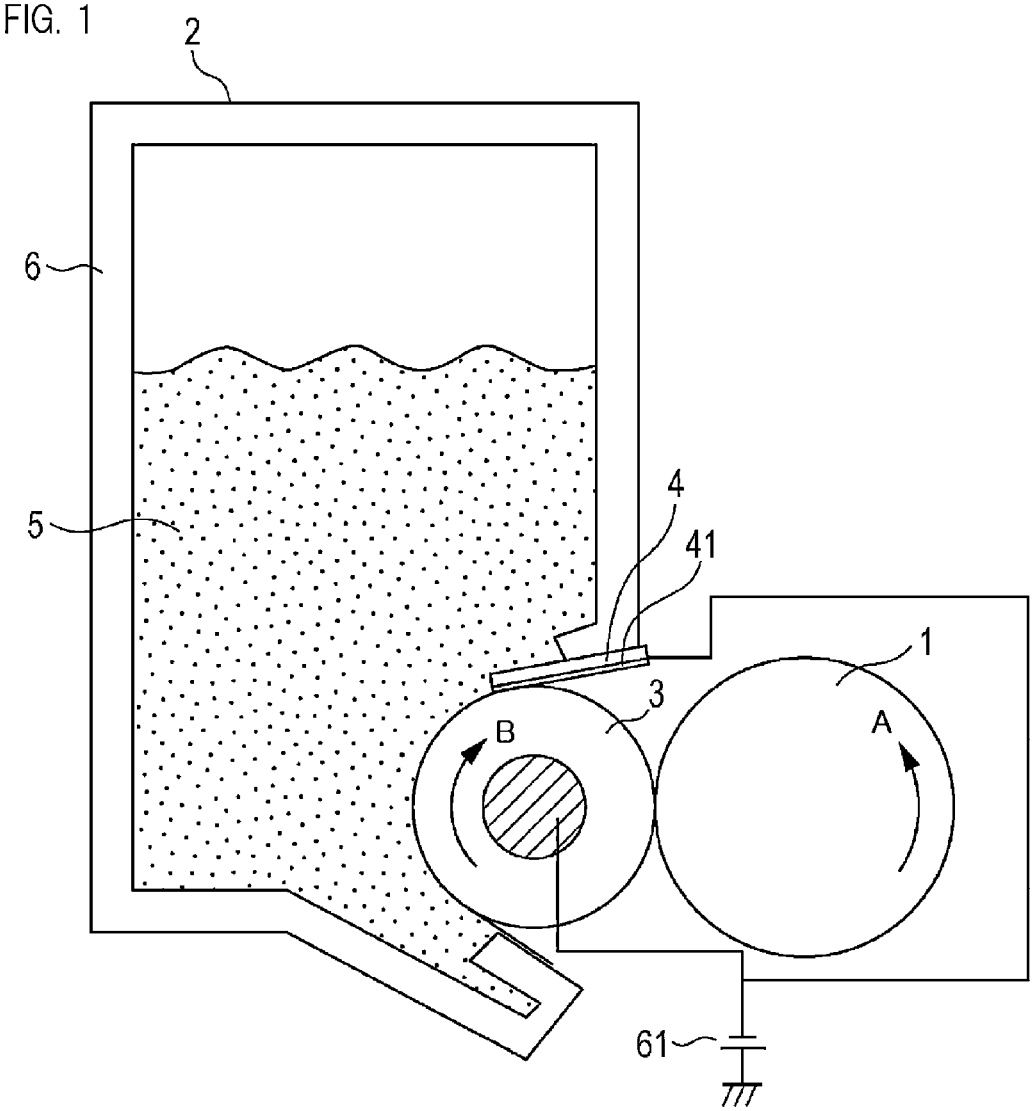
FIG. 1 is a schematic cross-sectional view of a developing assembly according to Example 1.

FIG. 1 shows a general configuration of the developing assembly 2 according to this example. The photosensitive drum 1, as an image bearing member, has a 24 mm outer diameter and is rotary-driven in the arrow A direction at a 150 mm/sec circumferential velocity. The developing assembly 2 is disposed to the left of the photosensitive drum 1. Known charging unit, exposure unit, transfer separation apparatus (transfer unit), cleaning unit and fixing apparatus (none of these are illustrated in FIG. 1) are disposed around the photosensitive drum 1 to execute the electrophotographic process.

As illustrated in FIG. 1, the developing assembly 2 of this example includes a developer container 6, a developing roller 3 and a metal blade (regulating blade) 4. The developer container 6 contains toner 5, which is non-magnetic one-component developer, and the developing roller 3 is rotary-driven in the arrow B direction at 180 mm/sec. In this example, the developing roller 3 is disposed contacting the surface of the photosensitive drum 1. The metal blade 4 functions as a regulating portion that regulates the layer thickness of toner on the developing roller. The metal blade 4 includes a charging layer 41, and has the functions of a charge applying unit that applies predetermined charges to the dielectric portion on the developing roller 3 via the toner 5, and a developer charging unit that applies predetermined charges to the toner 5.

The developing assembly 2 of this example has a configuration, which does not include a toner supply member, that contacts the developing roller 3, hence the above mentioned gradient force is used to bear the multilayer toner on the surface of the developing roller 3. For this, a high resistance dielectric portion 31 and an intermediate resistance dielectric portion 32, which have work functions that are different from each other, are disposed on the surface of the developing roller 3, and the dielectric portions are charged to different potentials by rubbing of the metal blade 4 via the toner, whereby a minute closed electric field is formed on the adjacent part of each dielectric portion. The toner conveyed to the surface of the developing roller 3 receives the gradient force by the minute closed electric field, and is sucked to and is borne on the surface of a developer bearing member.

Figure 2A:
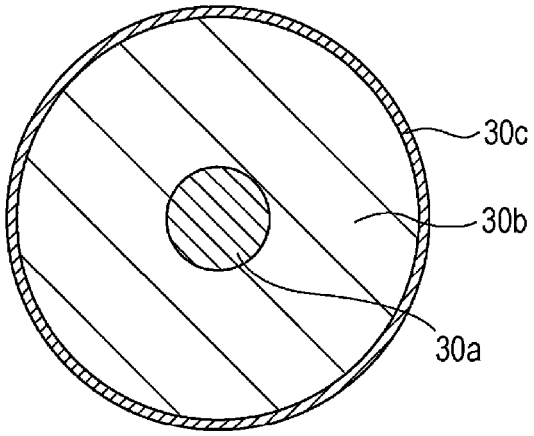
FIGS. 2A to 2C show schematic diagrams depicting the configuration of a developing roller according to Example 1.
Figure 2B:
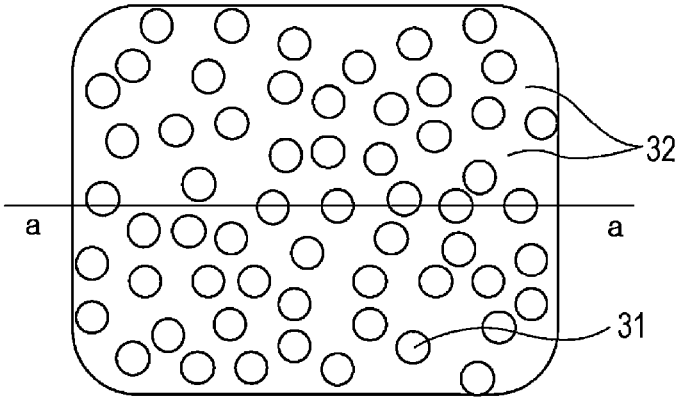
Figure 2C:
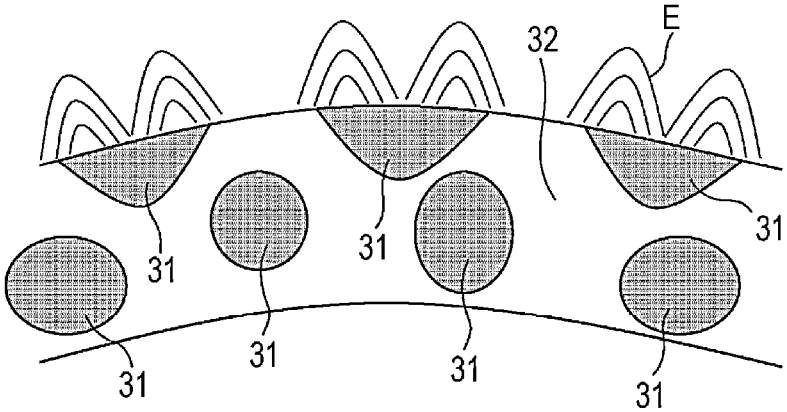

For the developing roller 3 of this example, a developing roller constructed such that the high resistance dielectric portion that can hold charges on the surface, and the intermediate resistance dielectric portion where charges can be held to a certain degree but decay, are exposed in minute areas, is used. FIG. 2 shows the developing roller 3 used in Example 1. FIG. 2A is a schematic cross-sectional diagram of the developing roller 3. FIG. 2B is a plan diagram of the surface of the developing roller 3. FIG. 2C is a cross-sectional diagram taken along cutting line a-a in FIG. 2B. The high-resistance dielectric portion 31 and the intermediate-resistance dielectric portion 32 are charged to different potentials as a result of contact with the toner to form a minute closed electric field (micro-fields) as shown by the electric lines of force E in FIG. 2C.

The size of the high resistance dielectric portion (size of the portion (circular portion) exposed to the circumferential surface of the developing roller 3 (intermediate resistance dielectric portion 32)) has about a 5 to 500 μm outer diameter, for example. This is an optimum value to hold charges on the surface and suppress image unevenness. If the outer diameter is less than 5 μm, the potential level held on the surfaces of the high resistance dielectric portion 31 and the intermediate resistance dielectric portion 32 is low, and a sufficient minute closed electric field cannot be generated. If the outer diameter is greater than 500 μm, the potential difference between the high resistance dielectric portion 31 and the intermediate resistance dielectric portion 32 increases, and an uneven image is generated.

Figure 3:
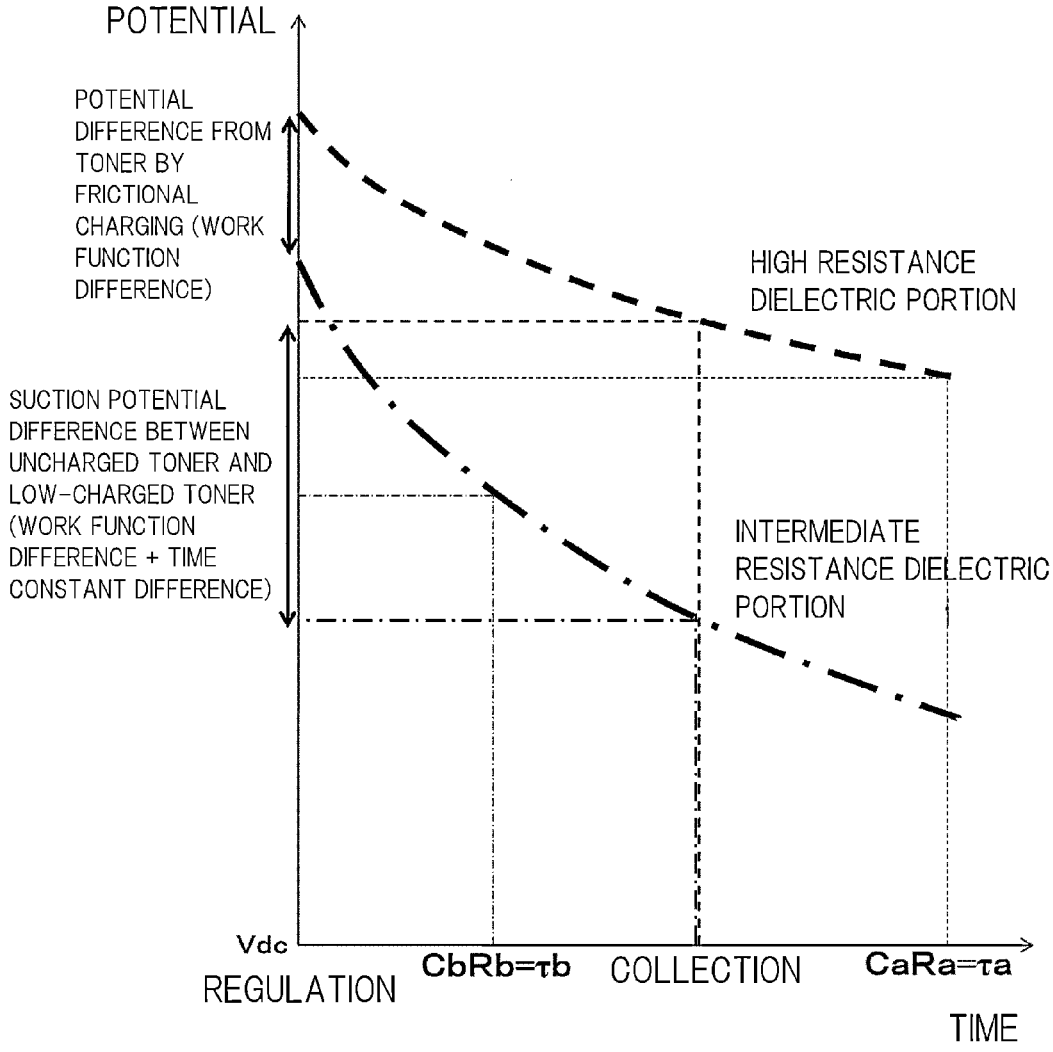
FIG. 3 is a diagram for explaining the relationship between the potential of the developing roller dielectric portion and time according to Example 1.

The charging amount of each dielectric portion also depends on the difference of the work functions from that of the externally added particles (not shown in the drawings) on the surface of the toner 5 contacting each dielectric portion. Furthermore, each dielectric portion is constituted by a material having a mutually different time constant and a different potential decaying speed. FIG. 3 shows a state of decaying of each dielectric portion with respect to the charging potential and time. The high resistance dielectric portion 31 and the intermediate resistance dielectric portion 32 have the same polarity, but are charged to mutually different potentials due to rubbing with the externally added particles on the surface of the toner 5 in the regulating portion, due to the above mentioned relationship of the work functions, and move to the developing position in the state where the minute closed electric field is formed. Then each dielectric portion moves to the collection position and enters the developer container 6 again. While moving from the regulating position to the collection position, the potential charged in each dielectric portion decays along the curve shown in FIG. 3. The developing roller 3 is an RC circuit, hence if the time constants of the potentials charged in the high resistance dielectric portion 31 and the intermediate resistance dielectric portion 32 are $\tau a$ and $\tau b$ respectively, then $\tau a = RaCa$ and $\tau b = RbCb$. Here the time constant refers to an index to indicate the response speed of the circuit (that is, the time required for the potential to decay down to a specific ratio), R denotes the resistance component of the dielectric portion, which is an electric resistance value, and C denotes a capacitance component of the dielectric portion, which is an electrostatic capacitance. In this example, each dielectric portion is configured such that $\tau a > \tau b$, that is $RaCa > RbCb$ is established. Then it takes time for the potential of the high resistance dielectric portion to decay (decay does not easily occur). In other words, even if the potential of each dielectric portion decays along the path from the regulating portion to the collection position, the absolute value of the potential of the high resistance dielectric portion 31 can be maintained to be higher than the absolute value of the potential of the intermediate resistance dielectric portion 32. Each dielectric portion can enter the developer container 6 in the collection position while maintaining the minute closed electric field between the high resistance dielectric portion 31 and the intermediate dielectric portion 32, and can suck and bear the uncharged or low-charged toner by the gradiant force (details described later).

Further, after the toner layer thickness is regulated by the metal blade 4, the intermediate resistance dielectric portion 32 must have potential when the development cycle T of the developing roller 3 elapses, and also the intermediate resistance dielectric portion 32 must maintain the minute closed electric field. Therefore it is preferable that the electric resistance value Rb and the electrostatic capacitance value Cb of the intermediate resistance dielectric portion 32 satisfy $CbRb \geq T/Ln10$ (Ln: natural logarithm) with respect to the development cycle T of the developing roller 3. Then the intermediate resistance dielectric portion 32, charged by a predetermined method, can maintain at least 10% of the charge amount after T elapses. In this example, this relationship is satisfied and the minute closed electric field is generated by setting $CR \geq 0.091$.

The volume resistivity of the dielectric particles was measured by applying a 1000V voltage to the measurement target sample for 30 seconds under a 23° C./50% RH environment using a Hiresta-UP® resistance measuring apparatus made by Mitsubishi Chemical Corporation. The amount of the measurement target sample to be used is preferably adjusted considering the density of the measurement target particles and the like, and to measure acrylic resin particles, for example, 0.6 g of acrylic resin particles, compressed by applying 2000 kgf/cm$^2$ pressure, are used as the measurement target sample. The specific dielectric constant of the dielectric particles is measured as follows. First the powder sample is placed in a cylinder of which base area is 2.26 cm$^2$, and the upper and lower electrodes are pressurized at 15 kg. At the same time, AC voltage (1 Vpp, 1 MHz) is applied and current is normalized to calculate the specific dielectric constant. To measure CR of the dielectric portion 31 on the surface of the developing roller 3, the dielectric portion 31 may be charged by a predetermined method, and the decay rate thereof may be measured. For example, a measurement sample, of which surface is 1 cm×1 cm and thickness is 3 mm, is extracted from the developing roller 3, and + ions are emitted to the sample by a Zerostat®3 gun made by MILTY Corporation. Then the potential of the dielectric portion 31 is measured at a predetermined time interval in KFM mode by a scanning probe microscope (SPA 300 made by SII Nanotechnology Corporation), and CR is calculated from the potential decay rate.

To form such a surface layer 30*c* as shown in FIG. 2A, for example, the intermediate-resistance dielectric is formed of a urethane resin and applied onto a conductive substrate such as aluminum, iron, or copper to a thickness of approximately 0.5 mm. Then, a high-resistance dielectric formed of polyethylene having a work function significantly different from the work function of the intermediate-resistance dielectric is thermally melted to adhere to the surface of the intermediate-resistance dielectric so as to be, for example, 200 μm square with a thickness of 50 μm. Thus, the developing roller 3 is formed which has the surface layer 30*c* including the intermediate-resistance dielectric portion 32, formed of a urethane resin, and the high-resistance dielectric portion 31, formed of polyethylene. At this time, the total area of the intermediate-resistance dielectric portions 32 is set to be 50% of the area of the entire surface of the surface layer 30*c* (thus, the total area of the high-resistance dielectric portions 31 is 50% of the area of the entire surface). In this example, a contact developing system is used, and it is preferable, so that the photosensitive drum 1 is not damaged, that the developing roller 3 is an elastic roller where the JIS hardness measured from the surface is in a 30 to 70 degree range. The method of forming the minute high resistance dielectric portion 31 and intermediate resistance dielectric portion 32 is not limited to the above method, but can be various other methods. For example, the developing roller 3 includes an elastic layer 30*b* formed of a conductive rubber material and a surface layer 30*c* both of which are provided on an outer periphery of an axial core body 30*a* as shown in FIG. 2A. The developing roller 3 can be produced by forming a surface layer 30*c* of a conductive resin material with dielectric particles dispersed therein, on the elastic layer 30*b* using coating or the like and then polishing the surface of the surface layer 30*c*.

Although described below in detail, the developing system according to Example 1 utilizes the relation of the work function among the high-resistance dielectric portion 31 and intermediate-resistance dielectric portion 32 on the surface of the developing roller 3, the charging layer 41 of the metal blade 4, and the toner. The work functions of the materials (polyethylene and urethane) used for the high-resistance dielectric portion 31 and intermediate-resistance dielectric portion 32 on the surface of the developing roller 3 were 5.57 eV and 5.86 eV when measured at an irradiation light amount of 250 nW using a surface analyzer (AC-2 manufactured by RIKEN KEIKI Co., Ltd.).

For the metal blade 4 according to Example 1, the charging layer 41 was formed by laminating a polyamide resin of thickness 0.1 mm on a thin phosphor bronze metal plate of thickness 0.1 mm. The work function of the charging layer 41 measured at 250 nW irradiation light quantity using the surface analyzer (AC-2 type, made by Riken Keiki Co., Ltd.) is 5.42 eV.

As the toner 5 according to Example 1, negative charge toner was used which contained a nonmagnetic styrene acrylic + polyester resin. The work function of the toner 5 was 6.01 eV when measured at an irradiation light amount of 250 nW using the surface analyzer (AC-2 manufactured by RIKEN KEIKI Co., Ltd.).

As the developing bias for contact development, a −300 V DC voltage is applied to the developing roller 3 from the high voltage power supply 61, which functions as the voltage applying unit. The photosensitive drum 1 is a negatively charged organic photoconductor (OPC), and is designed so that the latent image has −500 V in the solid white image area and −100 V in the solid image area. In order to acquire a satisfactory image density in this example, a 0.54 mg/cm$^2$ toner coating amount is required on the photosensitive drum 1 when the solid image is formed, and for this, a 0.45 mg/cm$^2$ toner coating amount is required on the developing roller 3.

Example 1 involves selecting the materials of the high-resistance dielectric portion 31 and intermediate-resistance dielectric portion 32 of the developing roller 3, the charging layer 41 of the metal blade 4, and the toner 5 so as to achieve the above-described work functions. Thus, a triboelectric series in the developing system is configured such that (−) toner 5<intermediate-resistance dielectric portion (one of the dielectric portions) 32<high-resistance dielectric portion (the other dielectric portion) 31<charging layer 41 (+). Such a configuration allows negative charge to be applied to the toner 5 and positive charge to be applied to the charging layer 41, the high-resistance dielectric portion 31, and the intermediate-resistance dielectric portion 32, respectively, based on the friction between the toner 5 and the charging layer 41, high-resistance dielectric portion 31, and intermediate-resistance dielectric portion 32. Moreover, in the triboelectric series, the friction between the toner 5 and the charging layer 41, high-resistance dielectric portion 31, and intermediate-resistance dielectric portion 32 causes a difference in potential between the surface of the developing roller 3 and the surface of the charging layer 41 which allows the negatively charged toner 5 to move to the charging layer 41.

The developing system according to Example 1 will be described using FIG. 5 (solid image formation) and FIG. 6 (solid white image formation). In Example 1, all of the toner on the developing roller 3 is used for development to form solid images. Void toner of the toner 5 shown in FIG. 5 and FIG. 6 are non- or low-charge toner. Particles of the toner shown by a − (minus) sign are charged by being regulated by the surface of the developing roller 3 and the charging layer 41 of the metal blade 4.

Figure 5A:
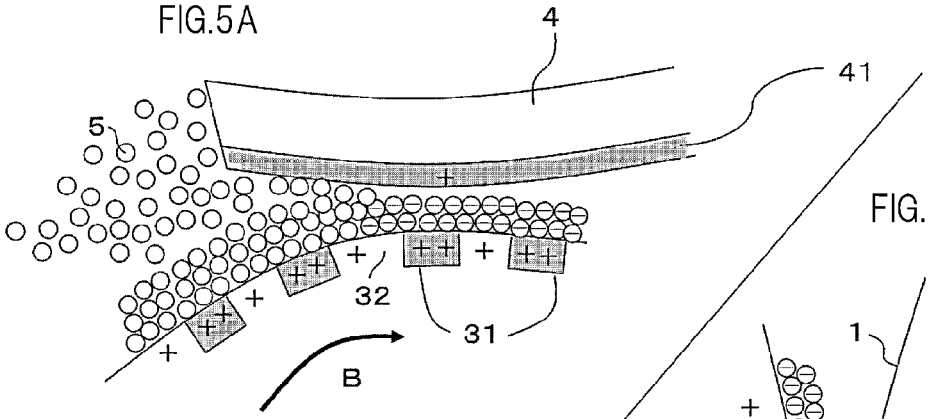
FIGS. 5A to 5C show explanatory drawings of a developing system according to Example 1 (solid image formation)
Figure 5B:
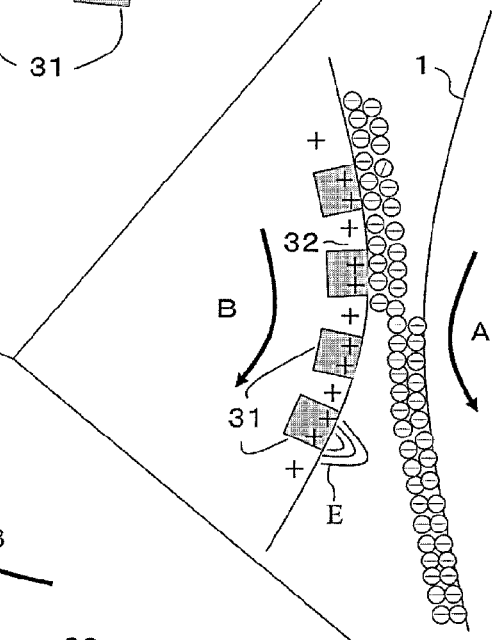
Figure 5C:
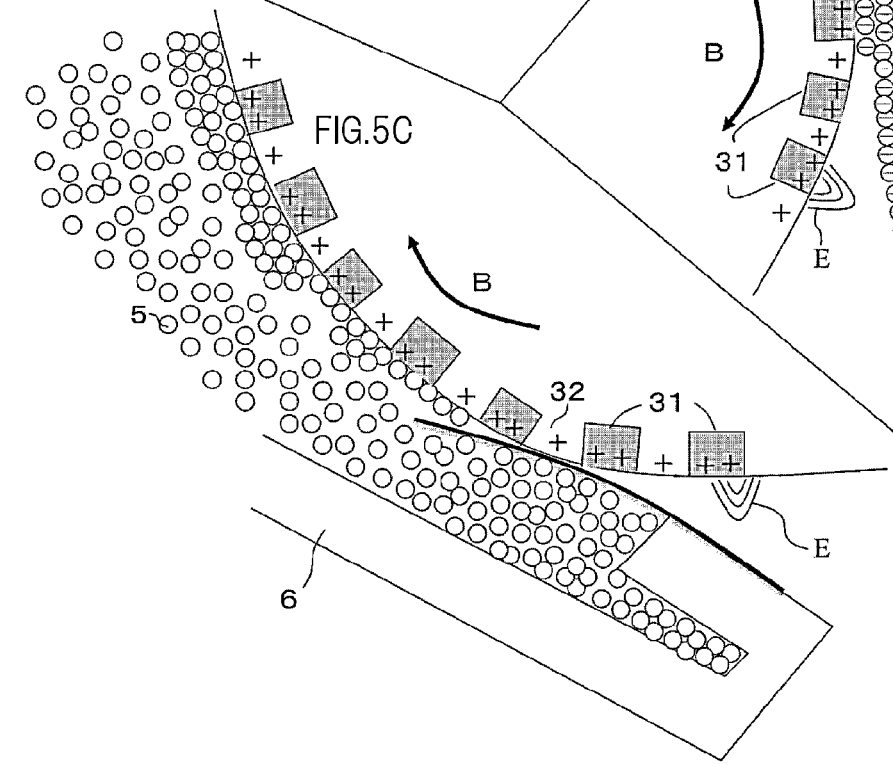

First, solid image formation will be described. As in the case of solid image formation, the regulating portion allows negative charge to be applied to the toner 5 and positive charge to be applied to the charging layer 41 and the dielectric portions 31 and 32, respectively, based on the friction between the toner 5 and the charging layer 41 and dielectric portions 31 and 32 as shown in FIG. 5A. The high-resistance dielectric portion 31 and the intermediate-resistance dielectric portion 32 have respective charges of different absolute values and cause the minute closed electric field to be formed between the high-resistance dielectric portion 31 and the intermediate-resistance dielectric portion 32. As illustrated in FIG. 5B, all the toner 5 on the developing roller 3 is developed by the developing unit. In the developer container 6, a toner layer constituted by about three layers is formed through the collection unit as illustrated in FIG. 5C by the gradient force due to the minute closed electric field generated on the developing roller 3. Then by the regulating portion, as illustrated in FIG. 5A, the toner coating amount for about two layers can always be acquired on the developing roller 3 even during solid image formation, so as to suppress the above mentioned solid image follow-up failure (details described later).

Figure 6A:
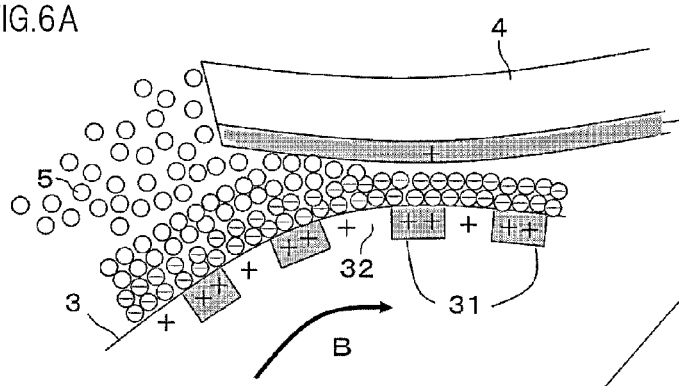
FIGS. 6A to 6C show explanatory drawings of the developing system according to Example 1 (solid white image formation)
Figure 6B:
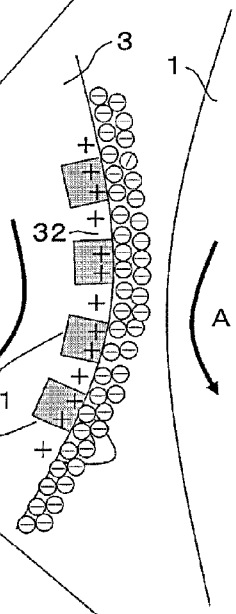
Figure 6C:
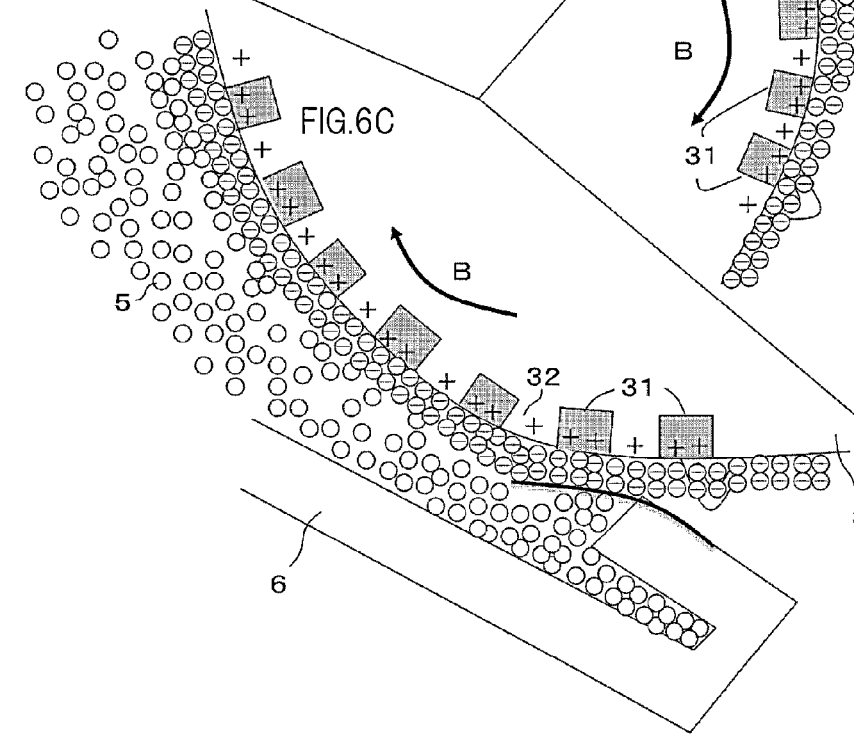

The solid white image formation will be described next. Just like the case of the solid black image formation, the above mentioned minute closed electric field is generated between the high resistance dielectric portion 31 and the intermediate resistance dielectric portion 32 by the regulating portion. Then as illustrated in FIG. 6B, all the toner 5 on the developing roller 3 is directed to the collection unit to the developer container 6 by the developing unit. In the developer container 6, a toner layer constituted by about four layers is formed through the collection unit as illustrated in FIG. 6C, by the gradient force due to the minute closed electric field generated on the developing roller 3. Then by the regulating portion, as illustrated in FIG. 6A, the toner coating amount for about two layers can be acquired on the developing roller 3 even during solid white image formation, using the regulation based on the triboelectric series difference between the developing roller 3 and the charging layer 41 of the metal blade 4, which is a characteristic of the present invention. In other words, the generation of the above mentioned ghost images can be suppressed by equalizing the toner coating amount after passing through the regulating portion when the solid image is formed, an when the solid white image is formed (details described later).

Here a ghost image suppression mechanism, which is a characteristic of the present invention, will be described in detail with reference to FIG. 7 and FIG. 8. In the toner 5 shown in FIG. 7 and FIG. 8, void toner is uncharged or low-charged, and toner indicated by − (minus) is toner charged by being regulated by the surface of the developing roller 3, the charging layer 41 of the metal blade 4, and toner 5 charged by the rotation of the surface of the developing roller 3.

Figure 7A:
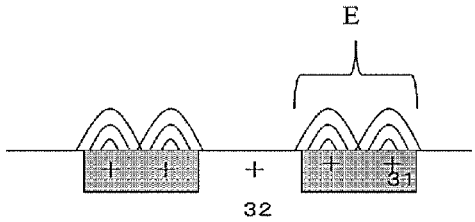
FIGS. 7A to 7F show explanatory drawings of a toner adhering mechanism according to Example 1.
Figure 7D:
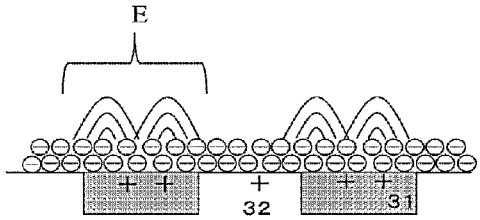
Figure 7B:
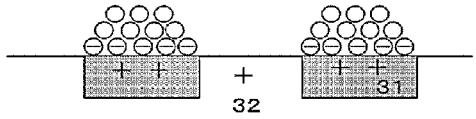
Figure 7E:
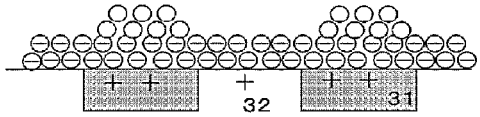
Figure 7C:
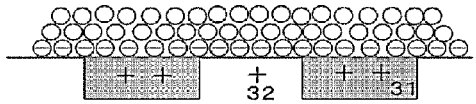
Figure 7F:
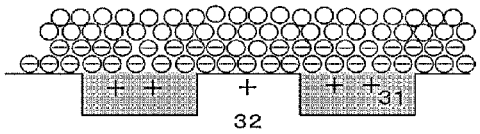

First a mechanism of the toner 5 adhering to the surface of the developing roller 3 when a solid image is formed will be described with reference to FIG. 7A, FIG. 7B and FIG. 7C, and the toner adhesion mechanism when a solid white image is formed will be described with reference to FIG. 7D, FIG. 7E and FIG. 7F. When the solid image is formed, the developing roller 3 returns into the developer container 6 in a state where the toner no longer exists on the surface thereof, as illustrated in FIG. 7A. As shown in FIG. 7B, the gradient force of the minute closed electric field E generated on the surface of the high-resistance dielectric portion 31 causes the non- or low-charge toner to be attached to the surface of the high-resistance dielectric portion 31, and the toner coming into contact with the surface of the high-resistance dielectric portion 31 is negatively charged. As shown in FIG. 7B, the toner attached to the surface forms roller surface unevenness and is borne in the gaps on the uneven surface. Approximately three toner layers shown in FIG. 7C are formed. At this time, the toner coming into contact with the intermediate-resistance dielectric portion 32 is also negatively charged. On the other hand, during solid white image formation, the high-resistance dielectric portion 31 is strongly positively charged, whereas the intermediate-resistance dielectric portion 32 is weakly positively charged, as shown in FIG. 7D. The surface of the roller 3 is coated by toner having negative polarity charges, and the surface potentials of the toner layer on the high resistance dielectric portion 31 and the intermediate resistance dielectric portion 32 is shifted to the negative polarity side. Then the minute closed electric field E is generated by the potential difference between the high resistance dielectric portion 31 and the intermediate resistance dielectric portion (the potential of the intermediate resistance dielectric portion 32 is higher in the negative polarity side). Then, as illustrated in FIG. 7E, the uncharged or low-charged toner 5 is suctioned by the gradient force onto the surface of the high resistance dielectric portion 32, where the minute closed electric field E is generated, generates an unevenness on the surface of the roller so as to bear the toner 5 in the gaps, and forms a toner layer constituted by about four layers, as illustrated in FIG. 7F.

Figure 8A:
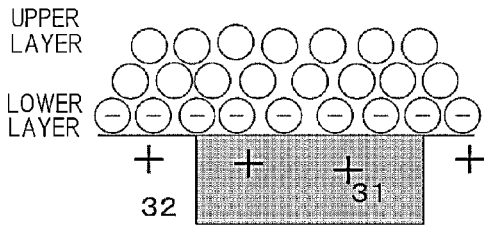
FIGS. 8A to 8F show explanatory drawings of a toner layer regulating mechanism according to Example 1.
Figure 8D:
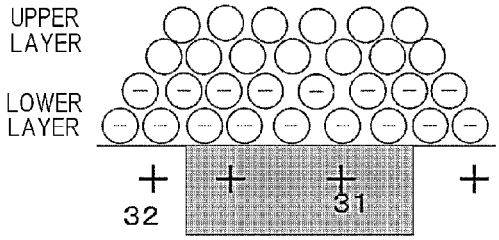
Figure 8B:
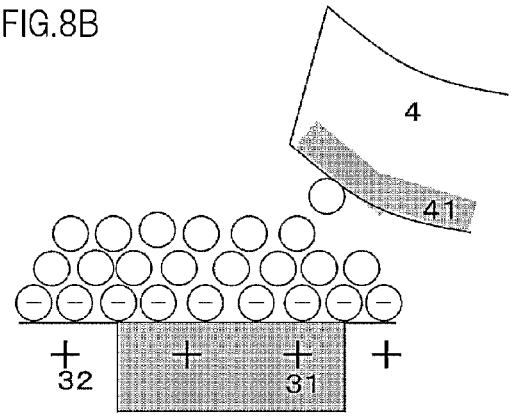
Figure 8E:
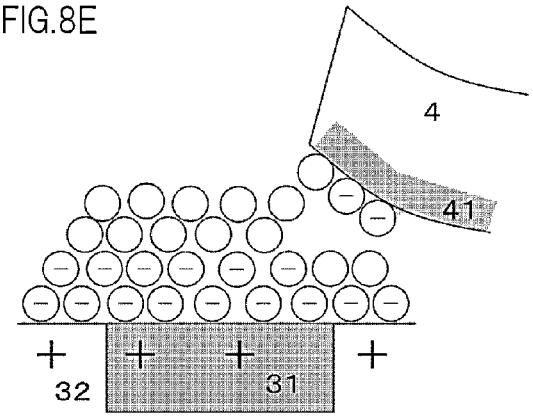
Figure 8C:
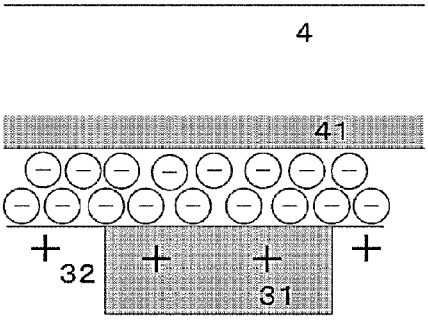
Figure 8F:
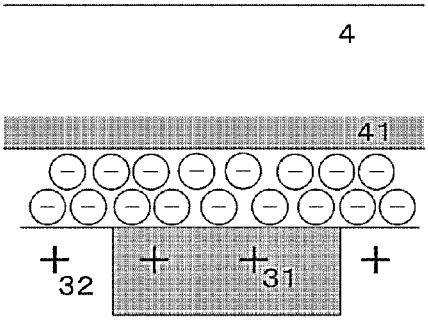
Figure 9A:
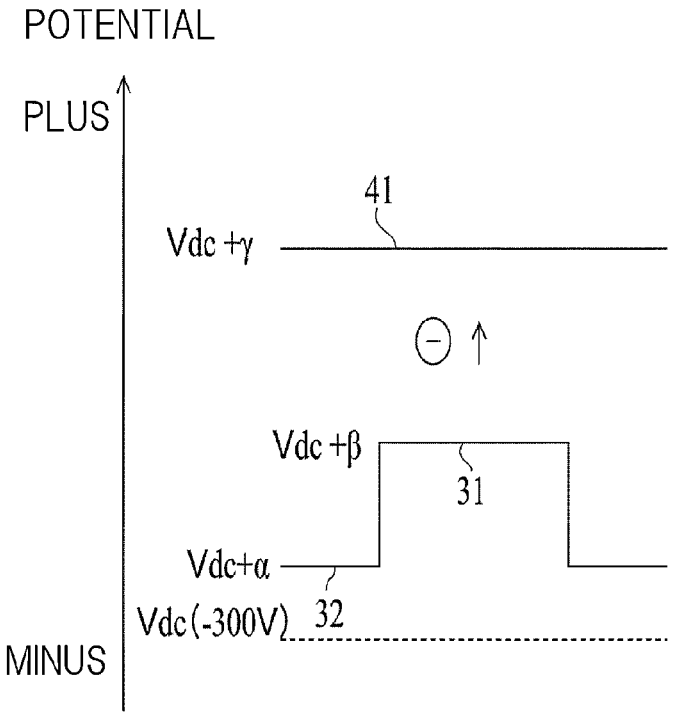
FIGS. 9A and 9B show diagrams depicting potential of the developing system according to Example 1.

Now a mechanism that regulates the toner layer on the surface of the developing roller 3 by the metal blade 4 when a solid image is formed will be described with reference to FIG. 8A, FIG. 8B and FIG. 8C, and the toner layer regulating mechanism when a solid white image is formed will be described with reference to FIG. 8D, FIG. 8E and FIG. 8F. When a solid image is formed, a toner layer constituted by about three layers is formed on the surface of the developing roller 3, as illustrated in FIG. 8A, and the toner on the upper layer, which is less restricted by the gradient force, is mechanically scraped off from the surface of the developing roller 3, as illustrated in FIG. 8B. The toner on the lower layer is conveyed to the regulating portion and is negatively charged, as illustrated in FIG. 8C. When a solid white image is formed, on the other hand, a toner layer constituted by about four layers is formed on the surface of the developing roller 3, and is regulated as illustrated in FIG. 8D. In Example 1, the triboelectric series is configured such that (−) toner 5<intermediate-resistance dielectric portion 32<high-resistance dielectric portion 31<charging layer 41 (+). Thus, the potential relation between the intermediate-resistance dielectric portion 32 and the high-resistance dielectric portion 31 and the charging layer 41 is such that the intermediate-resistance dielectric portion 32=the developing bias (hereinafter referred to as Vdc)+$\alpha$, the high-resistance dielectric portion 31=Vdc+$\beta$, and the charging layer 41=Vdc+$\gamma$, as shown in FIG. 9A. Due to the difference in the work function, $0<\alpha<\beta<\gamma$. Thereby as illustrated in FIG. 8E, the minus toner on the surface of the developing roller 3 can be easily scraped off from the surface of the developing roller 3, by the electric field between the charging layer 41 and the intermediate resistance dielectric portion 32/the high resistance dielectric portion 31. In this case, the minus toner is stacked in layers higher than the corresponding layers for solid image formation, causing more toner to be scraped off by electric fields.

In other words, according to this example, the toner coating amount after passing through the regulating portion is equalized when a solid image is formed and when a solid white is formed by the toner adhering mechanism to the surface of the developing roller 3 and the toner layer regulating mechanism described above. Thereby the generation of a ghost can be suppressed without causing a solid image follow-up failure. Here the solid image formation and the solid white image formation, where the difference in the toner coating state on the surface of the developing roller 3 is most obvious, were compared in detail, but even when a half tone image is formed, the toner coating amount after passing through the regulating portion can be equalized by the above mentioned mechanisms.

Table 1 shows the results of the comparison of the level of anti-fogging durability in a high-temperature high-humidity environment caused by a difference in the charge amount between the high-resistance dielectric portion 31 and the intermediate-resistance dielectric portion 32. For the level of the anti-fogging durability, a level at which the image defect is visually unnoticeable is denoted by O. A level at which anti-fogging durability occurs in an image but is acceptable in practice is denoted by Δ. For the level of the anti-fogging durability, the developing assembly according to Example 1 was installed in the image-forming apparatus and used to form images on 10,000 A4-size sheets, and the resultant images were compared with one another. In a comparative example, the intermediate-resistance dielectric portions were replaced with conductor portions so as to have a charge amount of 0 V. Furthermore, the charge amount of the high-resistance dielectric portion 31 was adjusted in accordance with the area of the high-resistance dielectric portions 31.

TABLE 1

| Checked Item | High resistance dielectric portion charging amount [V] | Intermediate resistance dielectri portionc charging amount [V] | Anti-fogging durability |
|---|---|---|---|
| Example | 20 | 10 | ○ |
| Comparative Example | 10 | 0 | Δ |

When the difference in the charge amount was uniform among the dielectric portions, setting the charge amount of the intermediate-resistance dielectric portion 32 (conductor) to 0 V slightly degraded fogging during the latter half of the durability test in the high-humidity high-temperature environment. This is because, in the comparative example, the charge applied to the conductor in the high-humidity environment flows through the conductor portions to the core metal, leading to reduced triboelectricity. On the other hand, in Example 1, the charge applied to the toner on the intermediate-resistance dielectric portion 32 is restrained from flowing through the intermediate-resistance dielectric portion 32 to the core metal, thus preventing a reduction in triboelectricity. Thus, the degradation of fogging was not observed even during the latter half of the durability test in the high-temperature high-humidity environment.

Images were formed on 1,000 A4-size sheets using the image-forming apparatus in FIG. 4 according to Example 1. The suitable image density was maintained, no image defect occurred, and desirable images were obtained.

As described above, in the image-forming apparatus according to Example 1, the high-resistance dielectric portions 31 and the intermediate-resistance dielectric portions 32 were arranged on the surface of the developing roller 3 in a mixed manner so that each dielectric portion had a very small area and was exposed on the surface. Moreover, the toner 5, the high-resistance dielectric portion 31, the intermediate-resistance dielectric portion 32, and the charging layer 41 were configured such that, in the triboelectric series in the developing system, (−) toner 5<intermediate-resistance dielectric portion 32<high-resistance dielectric portion 31<charging layer 41 (+). Thus, an image-forming apparatus including a developing assembly with no developer supply member (toner supply roller) can be provided which excellently prevents ghost and solid image follow-up failure.

In Example 1, the developing roller 3, the metal blade 4, and the toner 5 are formed of the above-described materials. However, Example 1 is not limited to such a configuration. Any other configuration may be adopted provided that the materials are configured such that, in the triboelectric series, the high-resistance dielectric portion 31 and the intermediate-resistance dielectric portion 32 are positioned between the toner 5 and the metal blade 4 and that the intermediate-resistance dielectric portion 32 is positioned between the toner 5 and the high-resistance dielectric portion 31.

Figure 9B:
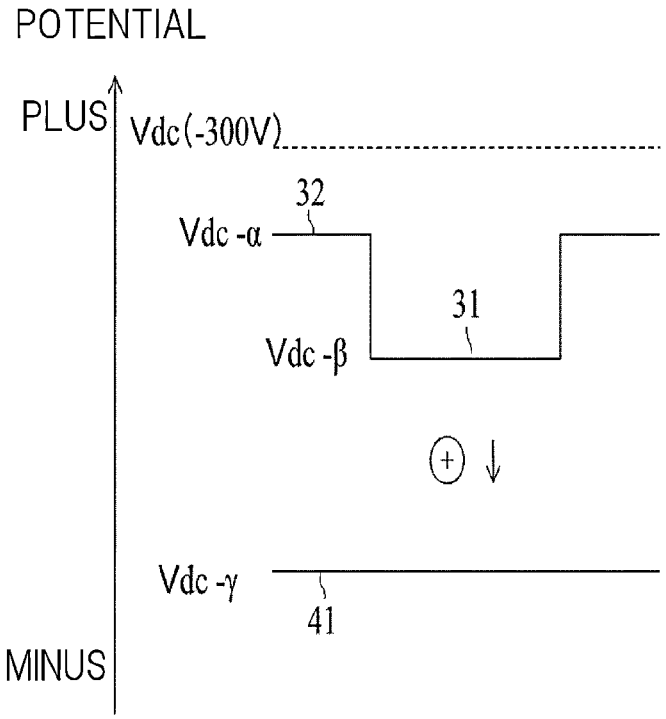

For example, if the toner 5 is positively charged, the materials are configured such that the charging layer 41 and the dielectric portions 31 and 32 are charged to the negative charge polarity, which is opposite to the polarity of the toner 5 and that (−) charging layer 41<high-resistance dielectric portion 31<intermediate-resistance dielectric portion 32<toner 5 (+). This enables the potential relation between the intermediate-resistance dielectric portion 32 and the high-resistance dielectric portion 31 and the charging layer 41 to be set as shown in FIG. 9B. Furthermore, if, in the triboelectric series, a marked difference in potential is present between the high-resistance dielectric portion 31 and the charging layer 41, then during regulation, the electric fields more effectively scrape off the toner on the developing roller 3, possibly reducing the image density. In this case, the suitable image density can be maintained by increasing the rotation speed of the developing roller 3.

In this example, the roughness of the developing roller 3 is not mentioned, but the toner conveyance performance can be controlled by the surface roughness of the developing roller 3, so as to increase the effect of suppressing a ghost and solid image follow-up failure.

In Example 1, the conductivity of the charging layer 41 has not been described. However, conductivity enables the charging layer 41 to be prevented from being charged up, restraining the toner from being provided with unwanted charge. Even the use of such a conductive charging layer 41 avoids affecting the above-described mechanism for preventing ghost and allows effects comparable to the effects of the Example 1 to be exerted. That is, the effects of the present invention can be exerted regardless of whether the charging layer 41 is conductive or insulated.

In Example 1, the metal blade 4 is provided with the charging layer 41. However, even if the charging layer 41 is omitted, effects comparable to the effects of Example 1 can be exerted provided that the work function of the material of the metal blade 4 has the above-described relation with the work functions of the high-resistance dielectric portion 31, the intermediate-resistance dielectric portion 32, and the toner 5.

Figure 11A:
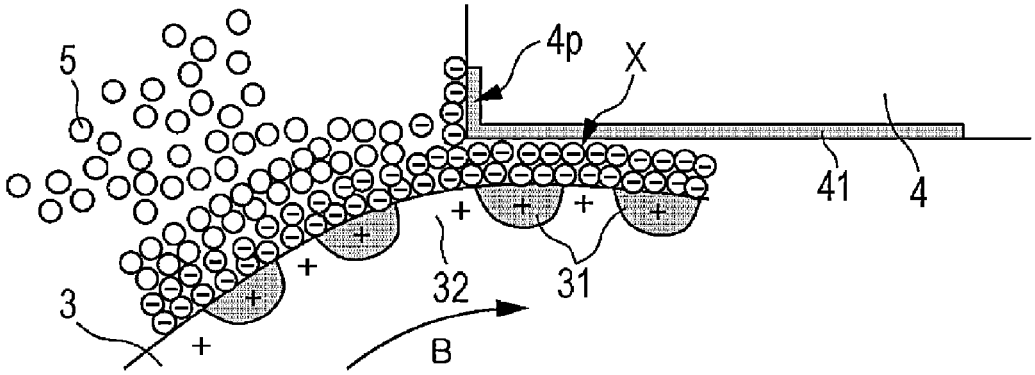
FIGS. 11A and 11B are diagrams illustrating another regulation method according to Example 1.
Figure 11B:
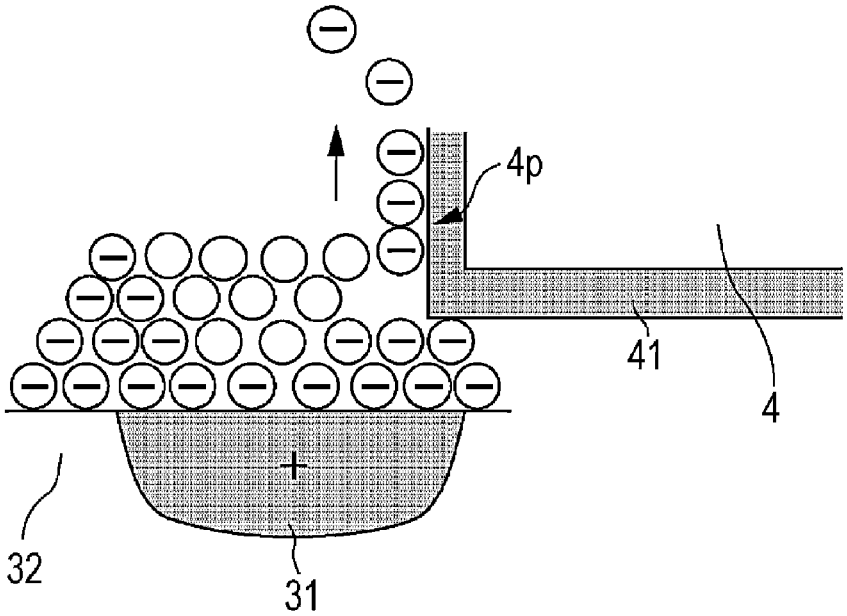

In Example 1, a method for bringing the developing roller 3 and the metal blade 4 into contact with each other is not described. However, to make the present invention more effective, the metal blade 4 may be arranged such that a leading end surface of the metal blade 4 faces in a normal direction with respect to the developing roller 3 as shown in FIG. 11A. In this case, the metal blade 4 is suitably provided with a guiding portion 4*p* located at a leading end of the metal blade 4 to guide the toner to the outside of an opposite area X across which the metal blade 4 and the developing roller 3 lie opposite each other. Thus, as shown in FIG. 11B, the minus toner in the upper layer scraped off by electric fields attaches to the charging layer 4*l* of the guiding portion 4*p* of the leading end of the metal blade 4 and is pushed up and guided in the direction of an arrow by continuously conveyed minus toner. Consequently, the minus toner scraped off by electric fields does not remain in the regulating portion, and the upper layer of minus toner on the surface of the developing roller 3 is more reliably scraped off. Therefore, effects comparable to the effects of Example 1 can be exerted.

In Example 1, the photosensitive drum 1 and the developing roller 3 are arranged in contact with each other. However, to eliminate pressure exerted on the toner during contact development, the photosensitive drum 1 and the developing roller 3 may be arranged so as not to contact each other.

In the developing roller 3 in Example 1, the surface layer 30C is configured such that the plurality of high-resistance dielectric portions 31 is scattered over the surface of the layer of the intermediate-resistance dielectric portions 32. Here, the "scattering" is not limited to the state in which the high-resistance dielectric portions 31 are separated from one another but may include a state where some of the high-resistance dielectric portions 31 are in contact with one another as shown in FIG. 2B. That is, the high-resistance dielectric portions 31 may be regularly or irregularly distributed over a certain portion of the entire surface of the intermediate-resistance dielectric portions 32 without concentrating at one position. In FIG. 2B, the intermediate-resistance dielectric portions 32 correspond to the sea in a sea-island type, whereas the high-resistance dielectric portions 31 correspond to islands in the sea-island type. A configuration opposite to this configuration is possible where the plurality of intermediate-resistance dielectric portions 32 corresponding to islands is in the high-resistance dielectric portions 31 corresponding to the sea.

Figure 10:
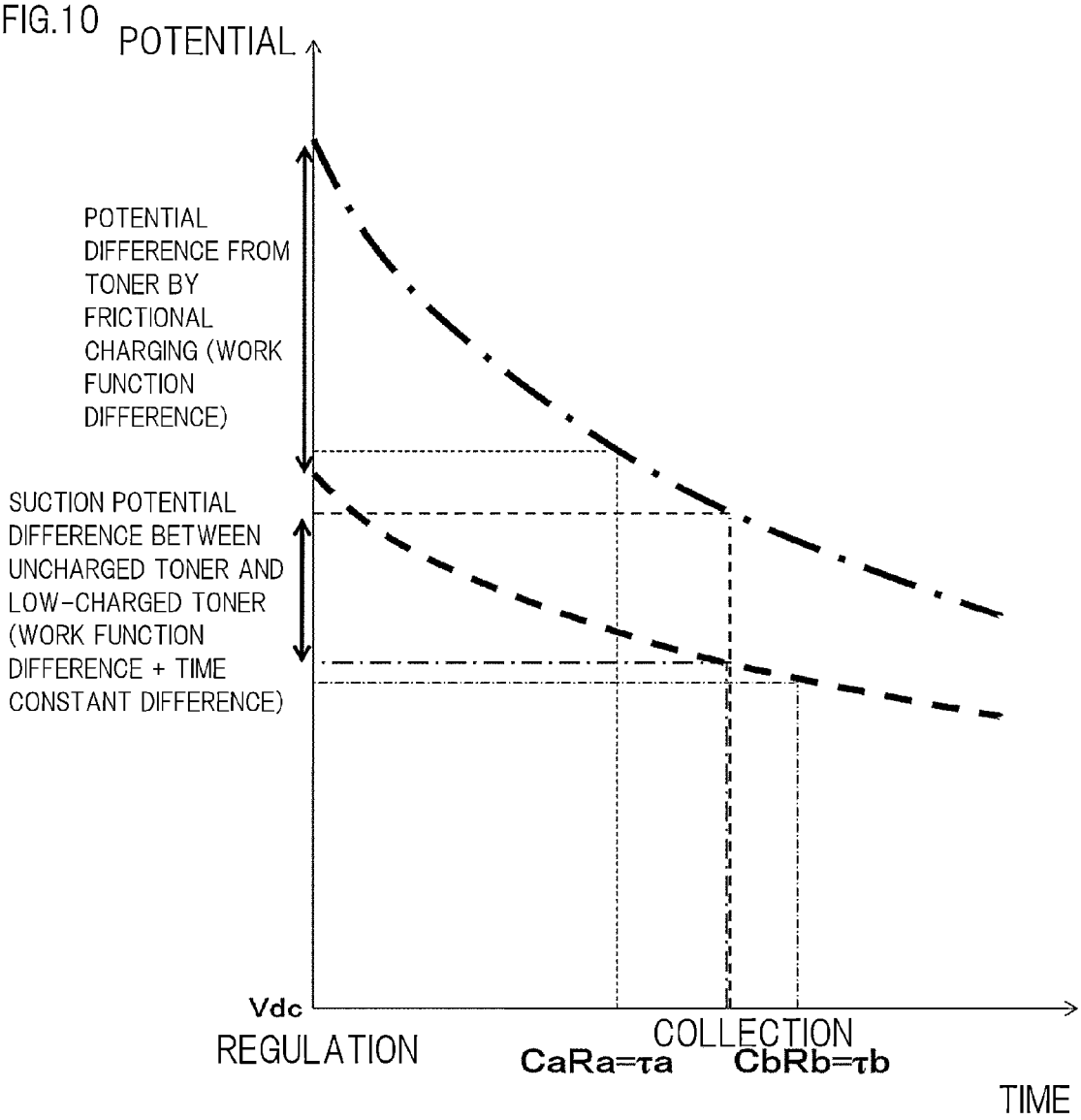
FIG. 10 is a diagram for explaining the relationship between the potential of the developing roller dielectric portion and time according to Example 1.

In Example 1, the materials of the high-resistance dielectric portion and the intermediate-resistance dielectric portion are selected such that the difference in work function between the externally added particles contained in the toner 5 and the high-resistance dielectric portions 31 is greater than the difference in work function between the externally added particles and the intermediate-resistance dielectric portion 32 and that the relation RaCa>RbCb is established. Thus, the potential of the charge on each dielectric portion decays along the curve shown in FIG. 3. However, a configuration that exerts the effects of the present invention may be such that the difference in work function between the externally added particles contained in the toner 5 and the high-resistance dielectric portions 31 is greater than the difference in work function between the externally added particles and the intermediate-resistance dielectric portion 32 and that the relation RbCb>RaCa is established as shown in FIG. 10. In other words, the time constant RaCa of the high-resistance dielectric portion may be small, and the potential of the high-resistance dielectric portion decays faster than the potential of the intermediate-resistance dielectric portion. However, in that case, the regulating portion preferably sets a marked difference in potential between the high-resistance dielectric portion and the intermediate-resistance dielectric portion. This is to keep the absolute value of the potential of the high-resistance dielectric portion larger than the absolute value of the potential of the intermediate-resistance dielectric portion from the regulating portion to the recovery portion.

Example 2

An image-forming apparatus according to Example 2 of the present invention will be described with reference to FIG. 12 and FIG. 13. Only differences from Example 1 will mainly be described. Components similar to the corresponding components of Example 1 are denoted by the same reference numerals and will thus not be described below. Matters not described in Example 2 are similar to the corresponding matters in Example 1.

The image-forming apparatus according to Example 2 is configured as described below. Unlike in the developing assembly 2 according to Example 1, the charging layer 41 of the metal blade 4 is omitted, and a blade bias is applied to the metal blade 4 to control the amount of toner coat on the surface of the developing roller 3 as shown in FIG. 12.

Figure 13A:
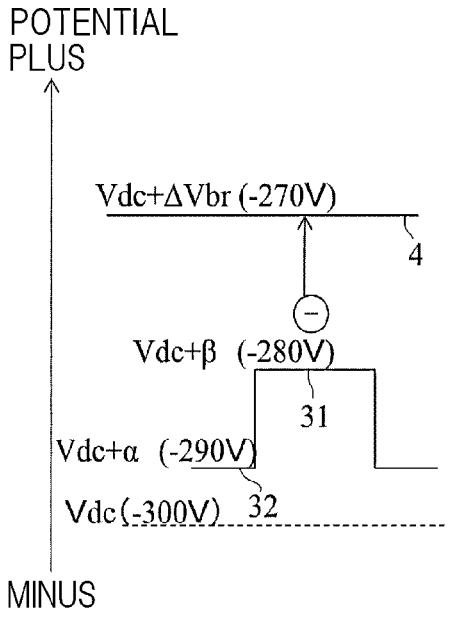
FIGS. 13A to 13D show diagrams depicting potential of the developing system according to Example 2.

As is the case with Example 1, the surface of the developing roller 3 according to Example 2 is configured such that the high-resistance dielectric portions 31 and the intermediate-resistance dielectric portions 32 are arranged on the surface in a mixed manner so that each of the dielectric portions has a very small area and is exposed on the surface. The triboelectric series is configured such that (−) toner 5<intermediate-resistance dielectric portion 32<high-resistance dielectric portion 31 (+). Thus, the potential relation between the intermediate-resistance dielectric portion 32 and the high-resistance dielectric portion 31 and the metal blade 4 is such that intermediate-resistance dielectric portion 32=Vdc+α, the high-resistance dielectric portion 31=Vdc+β, and the blade bias=Vdc+ΔVbr, as shown in FIG. 13A.

In Example 2, to form, using the blade bias, electric fields that allow the toner to be scraped off from the high-resistance dielectric portions 31 and the intermediate-resistance dielectric portions 32, the potential of each dielectric portion needs to be accurately determined. In Example 2, the potential of each dielectric portion was measured in accordance with the following procedure.

(1) After solid white image formation, the developing roller 3 is taken out, and a measurement sample of surface 1 cm×1 cm and thickness 3 mm is cut out.

(2) When 30 minutes elapse from the end of image formation, the potentials of the high-resistance dielectric portion 31 and intermediate-resistance dielectric portion 32 of the sample are measured in the KFM mode of the scanning probe microscope (SPA300 manufactured by SII Nano Technology Inc.).

(3) Potential decay in 30 minutes is calculated from the dielectric constants and resistivities of the high-resistance dielectric portion 31 and the intermediate-resistance dielectric portion 32 to determine the potentials for image formation.

In Example 2, for the values measured in (2), the high-resistance dielectric portion 31 has a potential of 11 V, whereas the intermediate-resistance dielectric portion 32 has a potential of 2.5 V. The high-resistance dielectric portion (polyester resin particles) adopted for Example 2 had a dielectric constant of 3.2, a resistivity of 1E+14 (Ω·m), and a potential decay rate of 47%, and thus had a potential of 20. 8 V during image formation. On the other hand, the intermediate-resistance dielectric portion 32 (urethane) had a dielectric constant of 7, a resistivity of 2E+13 (Ω·m), and a potential decay rate of 76%, and thus had a potential of 10.7 V during image formation.

Table 2 shows the results of image formation in Example 2 where a high voltage power source 61 serving as voltage applying means applied a blade bias to the metal blade 4. For the levels of ghost and density, a level at which the image defect is visually unnoticeable is denoted by O. A level at which the image defect occurs in an image but is acceptable in practice is denoted by Δ. A level at which the image defect occurs in an image and is unacceptable in practice is denoted by ×. Example 2 uses negative charge toner, and thus, when a blade bias to the developing roller ΔVbr is applied in a plus direction, electric fields are generated in a direction in which the toner 5 migrates from the surface of the developing roller 3 to the metal blade 4.

TABLE 2

| High-resistance dielectric portion charging amount β [V] | Intermediate-resistance dielectric portion charging amount α [V] | Blade bias to the developing roller ΔVbr [V] | Ghost | Density |
|---|---|---|---|---|
| 20 | 10 | −50 | X | ○ |
| 20 | 10 | 0 | X | ○ |
| 20 | 10 | 10 | X | ○ |
| 20 | 10 | 20 | Δ | ○ |
| 20 | 10 | 30 | ○ | ○ |
| 20 | 10 | 100 | ○ | Δ |

Table 2 shows that ghost images are avoided by changing the blade bias to the developing roller ΔVbr from a minus to a plus. A mechanism for avoiding ghost images is similar to the corresponding mechanism in Example 1 and allows the toner in the third and fourth layers in FIG. 8B and FIG. 8E to be scraped off using electric fields resulting from application of the blade bias to the developing roller ΔVbr. In this case, as shown in FIG. 13A, the negative charge polarity toner 5 migrates from the surface of the developing roller 3 to the metal blade 4 side. In Example 2, the high-resistance dielectric 31 has a developing roller potential difference of approximately 20 V, and thus, the blade bias to the developing roller ΔVbr is +20 V to +30 V, allowing ghost images to be significantly avoided. Furthermore, when the blade bias to the developing roller is increased on the plus side, the toner on the developing roller 3 is more effectively scraped off by electric fields during regulation, thus reducing image density. However, the suitable image density can be maintained by increasing the rotation speed of the developing roller 3.

Figure 13B:
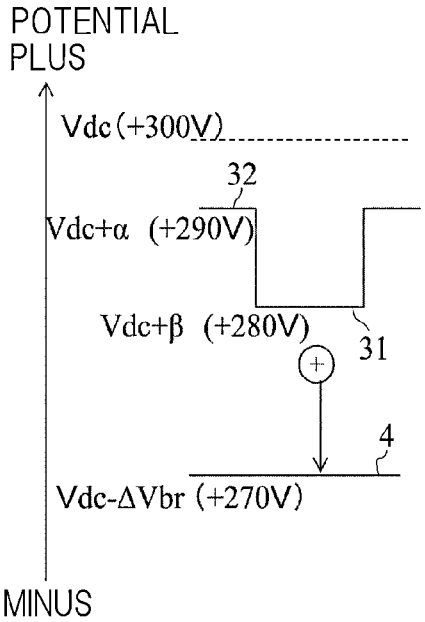
Figure 13C:
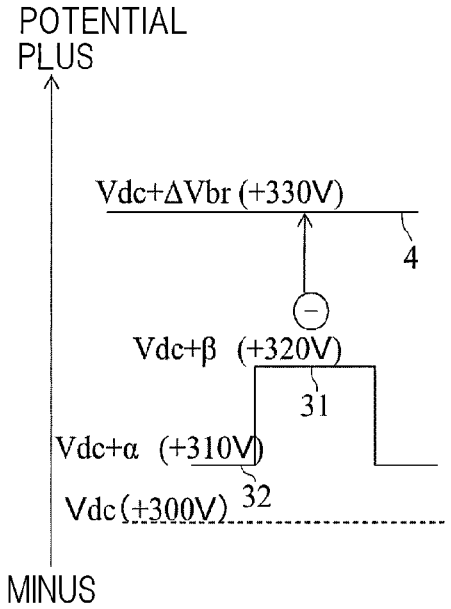
Figure 13D:
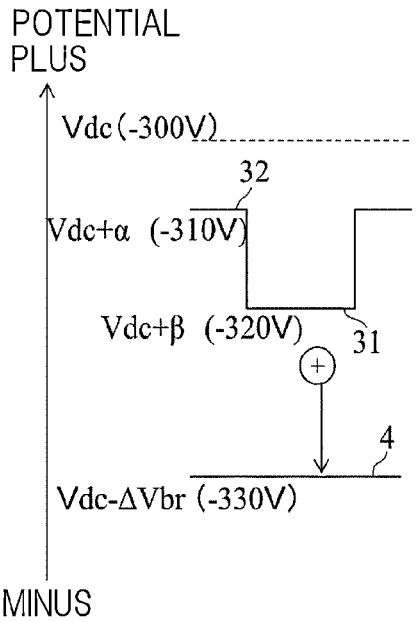

FIG. 13A, FIG. 13B, FIG. 13C, and FIG. 13D are schematic diagrams showing the potentials of the high-resistance dielectric portion 31, the intermediate-resistance dielectric portion 32, and the metal blade 4. In FIG. 13A, the apparatus is configured such that both the toner and the developing bias have a negative charge polarity, that is, such that the potential relation illustrated in Example 2 is established, and electric fields that cause the toner to be scraped off are generated on each of the dielectric portions. FIG. 13B shows a case where both the toner and the developing bias have a positive charge polarity. FIG. 13C shows a case where the toner has a negative charge polarity, whereas the developing bias has a positive charge polarity. FIG. 13D shows a case where the toner has a positive charge polarity, whereas the developing bias has a negative charge polarity.

Figure 12:
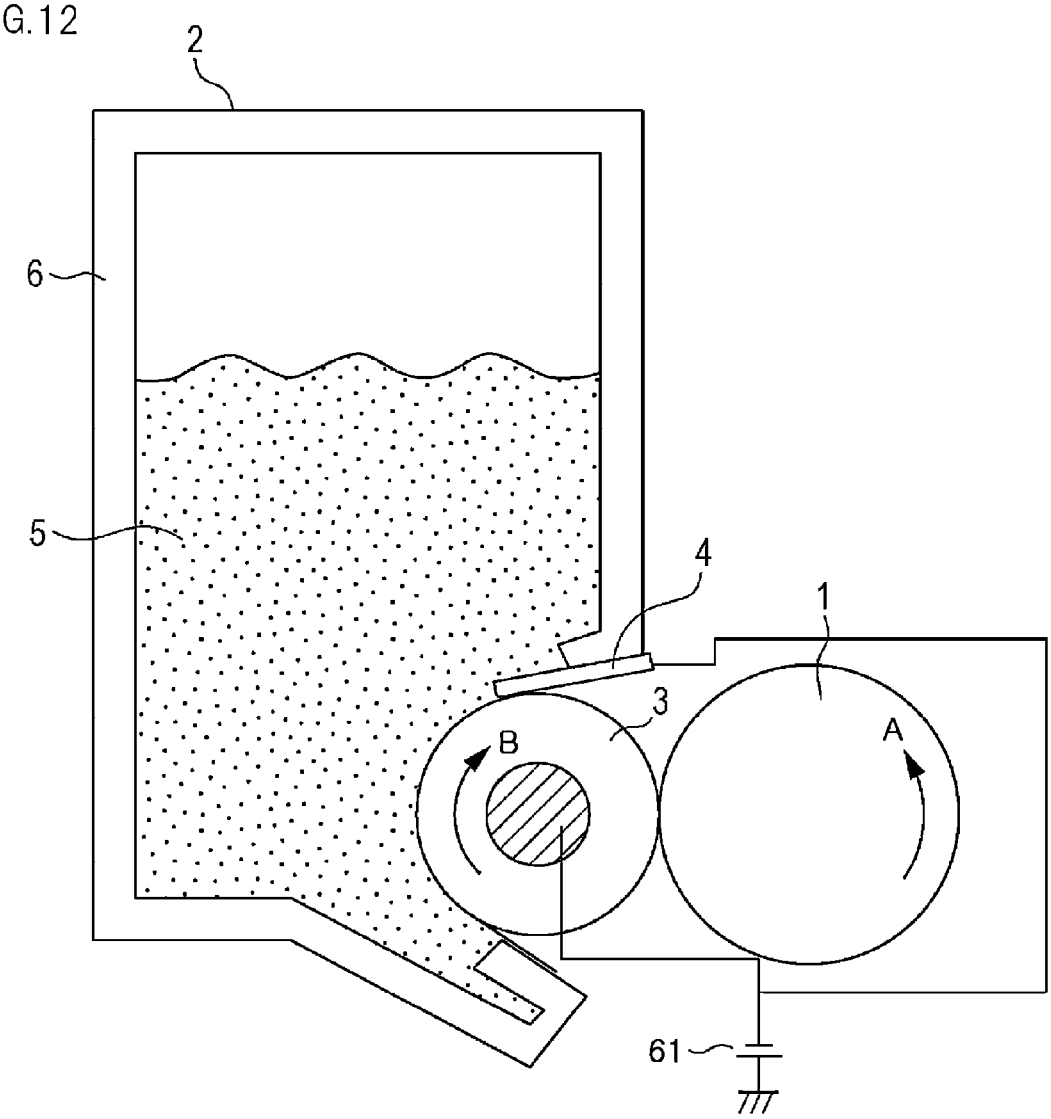
FIG. 12 is a schematic cross-sectional view of a developing assembly according to Example 2.

An image-forming apparatus with a developing assembly shown in FIG. 12 was used to form images on 1,000 A4-size sheets with the potentials of the intermediate-resistance dielectric portion 32, the high-resistance dielectric portion 31, and the metal blade 4 set as shown in FIG. 13A. The suitable image density was maintained, no image defect occurred, and desirable images were obtained. Furthermore, for the level of anti-fogging durability, the results were similar to the results shown in Table 1 in Example 1.

As described above, according to Example 2, the surface of the developing roller 3 is configured such that the high-resistance dielectric portions 31 and the intermediate-resistance dielectric portions 32 are arranged on the surface in a mixed manner so that each dielectric portion has a very small area and is exposed on the surface. The absolute values of potentials of the intermediate-resistance dielectric portion 32, the high-resistance dielectric portion 31, and the metal blade 4 are set to be in the above-described relation. Thus, an image-forming apparatus including a developing assembly with no developer supply member can be provided which significantly prevents ghost and solid image follow-up failure without increasing loads on the toner.

In Example 2, the metal blade 4, the high-resistance dielectric portion 31, the intermediate-resistance dielectric portion 32, and the toner 5 have the above-described material configuration. However, Example 2 is not limited to such a configuration. Any other configuration may be adopted provided that the materials are configured such that, in the triboelectric series, the intermediate-resistance dielectric portion 32 is positioned between the toner 5 and the high-resistance dielectric portion 31 and is thus conductive enough to be able to apply a bias to the metal blade 4.

For example, if the toner has a positive charge polarity, the materials may be configured such that (−) high-resistance dielectric portion 31<intermediate-resistance dielectric portion 32<toner 5 (+) and the metal blade 4 may be subjected to a negative potential with an absolute value larger than the absolute value of the charge amount of the high-resistance dielectric portion 31. This allows the potential relation between the intermediate-resistance dielectric portion 32 and the high-resistance dielectric portion 31 and the metal blade 4 to be set as shown in FIG. 13B. Furthermore, if a marked difference is present between the potential of the charged high-resistance dielectric portion 31 and the bias of the metal blade 4, then during regulation, the electric fields more effectively scrape off the toner on the developing roller 3, possibly reducing image density. In this case, the suitable image density can be maintained by increasing the rotation speed of the developing roller 3.

Finally, the effects of the above-described Examples will be summarized below. The configuration of each Example allows the image-forming apparatus to achieve better image formation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-173703, filed Aug. 23, 2013, which is hereby incorporated by reference herein in its entirety.

What is claimed is:

1. A developing assembly comprising:

a container that contains a developer;

a developer bearing member that bears the developer; and a regulating portion that regulates a layer thickness of the developer borne on the developer bearing member, wherein a surface of the developer bearing member on which the developer is borne is provided with a first dielectric portion and a second dielectric portion, and the regulating portion, the first dielectric portion, and the second dielectric portion each have a charge polarity opposite to a charge polarity of the developer, and in a triboelectric series, one of the first dielectric portion and the second dielectric portion is positioned between the developer and the other dielectric portion, and the other dielectric portion is positioned between the one dielectric portion and the regulating portion.

2. The developing assembly according to claim 1, wherein the first dielectric portion and the second dielectric portion are constituted by materials having different work functions, respectively.

3. The developing assembly according to claim 1, wherein the first dielectric portion and the second dielectric portion are configured in such a manner that, when an electric resistance value of the first dielectric portion is denoted by Ra, an electric resistance value of the second dielectric portion is denoted by Rb, and a capacitance is denoted by Cb, $RaCa \neq RbCb$ is satisfied.

4. The developing assembly according to claim 1, wherein, with respect to a value of the work function, the one dielectric portion is positioned between the developer and the other dielectric portion, and the other dielectric portion is positioned between the one dielectric portion and the regulating portion.

5. The developing assembly according to claim 1, wherein a difference in the work function between externally added particles contained in the developer and the other dielectric portion is greater than a difference in the work function between the externally added particles and the one dielectric portion.

6. The developing assembly according to claim 1, wherein the first dielectric portion and the second dielectric portion are formed on a surface of a conductive substrate.

7. The developing assembly according to claim 1, which is configured to be removably installed in a main body of an image-forming apparatus.

8. The developing assembly according to claim 7, wherein the developing assembly is removably installed in the main body of the image-forming apparatus as a part of a process cartridge having an image bearing member that bears an electrostatic latent image.

9. An image-forming apparatus comprising:

an image bearing member that bears an electrostatic latent image;

a container that contains a developer;

a developer bearing member that bears the developer;

a regulating portion that regulates a layer thickness of the developer borne on the developer bearing member; and first voltage applying means for applying a voltage to the developer bearing member, wherein a surface of the developer bearing member on which the developer is borne is provided with a first dielectric portion and a second dielectric portion, the regulating portion, the first dielectric portion, and the second dielectric portion each have a charge polarity opposite to a charge polarity of the developer, and in a triboelectric series, one of the first dielectric portion and the second dielectric portion is positioned between the developer and the other dielectric portion, and the other dielectric portion is positioned between the one dielectric portion and the regulating portion, and the electrostatic latent image is developed with the developer to form an image on a recording medium.

10. The image-forming apparatus according to claim 9, further comprising second voltage applying means for applying a voltage to the regulating portion.

11. The image-forming apparatus according to claim 9, wherein the first dielectric portion and the second dielectric portion are constituted by materials having different work functions, respectively.

12. The image-forming apparatus according to claim 9, wherein the first dielectric portion and the second dielectric portion are configured in such a manner that, when an electric resistance value of the first dielectric portion is denoted by Ra, an electric resistance value of the second dielectric portion is denoted by Rb, and a capacitance is denoted by Cb, $RaCa \neq RbCb$ is satisfied.

13. The image-forming apparatus according to claim 9, wherein, with respect to a value of the work function, the one dielectric portion is positioned between the developer and the other dielectric portion, and the other dielectric portion is positioned between the one dielectric portion and the regulating portion.

14. The image-forming apparatus according to claim 9, wherein a difference in the work function between externally added particles contained in the developer and the other dielectric portion is greater than a difference in the work function between the externally added particles and the one dielectric portion.

15. The image-forming apparatus according to claim 9, wherein the first dielectric portion and the second dielectric portion are formed on a surface of a conductive substrate.

* * * * *